US006578826B2

(12) United States Patent
Pilcher

(10) Patent No.: US 6,578,826 B2
(45) Date of Patent: Jun. 17, 2003

(54) FENCE POST REPAIR STAKES AND METHODS

(76) Inventor: Joseph Pilcher, 1616 Park Pl., Wichita, KS (US) 67203

( * ) Notice: Subject to any disclaimer, the term of this patent is extended or adjusted under 35 U.S.C. 154(b) by 9 days.

(21) Appl. No.: 09/864,498

(22) Filed: May 25, 2001

(65) Prior Publication Data

US 2001/0045553 A1 Nov. 29, 2001

Related U.S. Application Data

(60) Provisional application No. 60/221,237, filed on Jul. 27, 2000, and provisional application No. 60/207,624, filed on May 26, 2000.

(51) Int. Cl.[7] ..... E04H 17/22

(52) U.S. Cl. ..... 256/19; 256/DIG. 19; 52/165; 52/170

(58) Field of Search ..... 256/1, 19, DIG. 5; 135/118; 52/165, 170, 295, DIG. 10

(56) References Cited

U.S. PATENT DOCUMENTS

| | | | | | |
|---|---|---|---|---|---|
| 1,038,147 | A | * | 9/1912 | Johnson | 52/155 |
| 1,561,193 | A | * | 11/1925 | Spring | 52/170 |
| 1,584,405 | A | * | 5/1926 | Spring | 52/170 |
| 1,672,789 | A | * | 6/1928 | Spring | 52/170 |
| 1,712,364 | A | * | 5/1929 | Spring | 52/170 |
| 1,726,371 | A | * | 8/1929 | Spring | 52/170 |
| 1,755,461 | A | * | 4/1930 | Spring | 52/170 |
| 1,789,393 | A | * | 1/1931 | Spring | 52/170 |
| 1,811,899 | A | * | 6/1931 | Spring | 52/170 |
| 1,979,580 | A | * | 11/1934 | Spring | 52/170 |
| 2,026,157 | A | * | 12/1935 | Beecher | 52/170 |
| 2,265,452 | A | * | 12/1941 | Ruggieri | 52/170 |
| 3,350,822 | A | * | 11/1967 | Nachazel | 173/132 |
| 4,516,365 | A | | 5/1985 | Chapman | |
| 4,572,701 | A | * | 2/1986 | Parsons et al. | 404/50 |
| 4,598,512 | A | | 7/1986 | Chapman | |
| 4,646,489 | A | | 3/1987 | Feller et al. | |
| 4,697,396 | A | * | 10/1987 | Knight | 52/170 |
| 5,029,651 | A | | 7/1991 | Ubbink | |
| 5,085,281 | A | | 2/1992 | Selly | |
| 5,636,482 | A | | 6/1997 | Klager | |
| 5,875,805 | A | * | 3/1999 | Nichols | 119/788 |

FOREIGN PATENT DOCUMENTS

| | | | | | |
|---|---|---|---|---|---|
| GB | 2139663 | A | * | 11/1984 | E04H/12/22 |
| GB | 2177133 | A | * | 1/1987 | E04H/17/22 |

* cited by examiner

*Primary Examiner*—James R. Brittain
(74) *Attorney, Agent, or Firm*—Robert Blinn

(57) ABSTRACT

The repair stake for reinforcing a post includes an upper portion, a central portion and a lower portion. Fastener holes are present in the upper portion. The repair stake can driven between a deteriorating post and a concrete cast and attached to the deteriorating post to anchor the post.

7 Claims, 9 Drawing Sheets

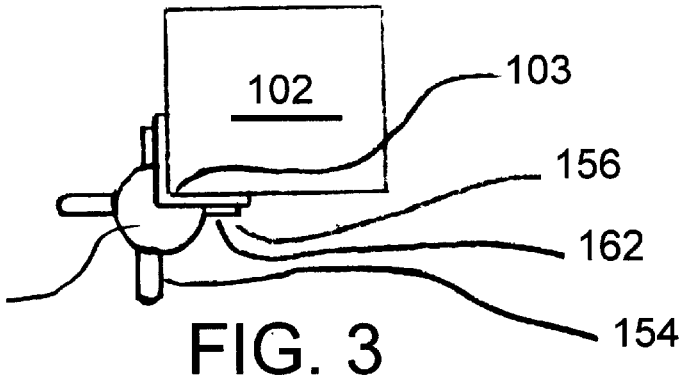
FIG. 3
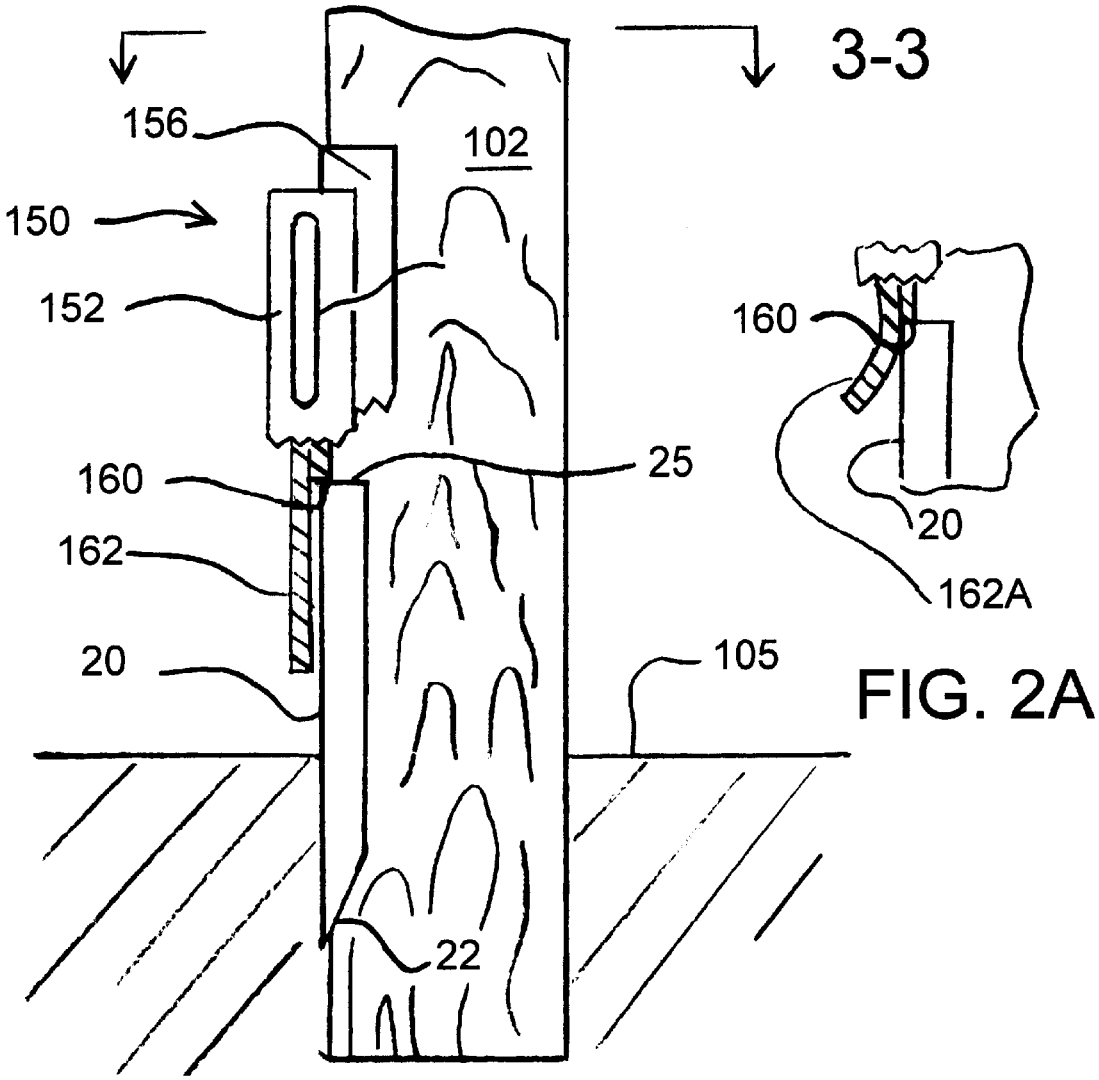
FIG. 2A
FIG. 2

FENCE POST REPAIR STAKES AND METHODS

CROSS REFERENCES TO RELATED APPLICATIONS

This application claims the benefit of U.S. Provisional Patent Application No. 60/207,624 filed May 26, 2000 and U.S. Provisional Patent Application No. 60/221,237 filed Jul. 27, 2000.

FIELD OF THE INVENTION

This invention relates to methods and hardware for reinforcing and repairing deteriorated fence posts.

BACKGROUND OF THE INVENTION

Wood fence posts tend to deteriorate even when they are imbedded in concrete footings. Replacement of deteriorated fence posts is very difficult, time consuming and expensive. Removing and replacing fence posts along a section of fence can also disrupt and damage landscaping. Although a fence post that has deteriorated at and below ground level can no longer support a section of fence, in most cases, the remaining portions of the post are in good condition and can still support a section of fence. Fence hardware is available for installing posts without the wooden post penetrating the surface of the ground. Such hardware is expensive and can be difficult to install. It is also questionable as to whether or not such hardware will last any longer than a conventional wooden post. What is needed is a method for reinforcing and repairing fence posts of a fence that are deteriorated at and below ground level that requires a minimum of effort, that will not disrupt landscaping and that will restore the structural integrity of the fence.

SUMMARY OF THE INVENTION

First Embodiment

The first embodiment of the fence post reinforcing hardware and method of the present invention satisfies this need by providing hardware and a method for installing that hardware which will substantially restore the structural integrity of a deteriorated fence post. The hardware of the present invention includes an angle iron stake and a stake driver for driving the angle iron stake down the corner of a fence post. The stake has a pointed lower end. The stake driver includes a body, handles, a first sliding surface for sliding along the corner of the fence post, a hammer surface for hammering the flat upper surface of the stake and a second surface extending below the hammer surface that is offset from the from the first sliding surface for retaining the stake against the fence post as the stake is being driven down the corner of the post.

The method for using the hardware of the present invention to reinforce a deteriorated post includes the following steps: (1) Hold the stake against a corner of the post. (2) Place the stake driver directly above the stake against the corner of the post so that the stake is trapped between the post and the second surface of the stake driver. (3) Slide the stake driver up and down the post so that the hammer surface of the stake driver strikes the flat upper surface of the stake to drive the stake down the corner of the post and into the ground. (4) Secure the stake to the post with fasteners.

The hardware and method of the present invention provides a way to restore the structural integrity of a fence by reinforcing fence posts deteriorated at and below ground level with an absolute minimum of time and effort. Using the hardware and method of the present invention, a worker can repair the deteriorated posts of a large section of fence with far less effort and material than would be required without using the invention hardware and method.

Second Embodiment

A second embodiment of the fence post repair stake and method includes a straight, generally flat upper portion, a straight, generally flat lower portion and a slightly curved central portion connecting the upper portion and the lower portion. The second embodiment of the fence post repair stake has a curved, three dimensional shape that curves out of the plane of the generally flat lower portion. The upper portion includes a fastening flange that projects at a right angle relative to the generally flat upper portion. The fastening flange and the rest of the upper portion have fastener holes. At the end of the flat lower portion of the stake is a cutting edge and a cutting flange that extends the cutting edge at an acute angle in relation to the stake. The lower portion of the stake, including the cutting flange, should have a width substantially equal to or slightly greater than that of a standard fence post.

The method for using the second embodiment repair stake to reinforce a damaged fence post that is embedded in a concrete cast includes the following steps: (1) Hold the stake against a first side of the fence post with the lower portion of the stake in contact with the one side of the fence post and the upper portion bent away from the fence post. The edges of the bottom portion of the stake should align with the edges of the fence post. (2) Strike the top end of the upper portion of the stake to drive the lower portion of the stake between the fence post and the concrete cast until the upper portion of the stake is so close to the side of the fence post that it can no longer be struck with the hammer. (3) Secure the upper portion of the stake to the fence post by inserting fasteners through the fastening holes in the upper portion to the first side of the fence post and then by inserting fasteners in the fastening holes in the fastening flange to a second adjacent side of the fence post. The resulting installation, if performed on two corners of a damaged fence post will return that fence post to its original strength.

The repair stake and method of the second embodiment provides a way to restore the structural integrity of a fence by reinforcing fence posts deteriorated at and below ground level with an absolute minimum of time and effort. Using the repair stake and method of the present invention, a worker can repair the deteriorated posts of a large section of fence with far less effort and material than would be required without using the invention hardware and method.

Third Embodiment

A third embodiment of a stake for reinforcing a rectangular post set in a concrete cast includes a generally flat blade. The flat blade has an upper portion which includes fastener holes for receiving fasteners for fastening to the post, a flat lower portion that is narrower than the upper portion and pointed at its lower end and a curved central portion connecting the upper portion to the lower portion. The upper portion, central portion and the lower portion all lie in a plane and define a serpentine or curved shape. The upper portion has an alignment edge that will align with a first wall of the concrete cast. The lower portion has an alignment edge that will also align with the first wall of the concrete cast. The central portion curves away from the upper portion and then back to the lower portion and has an alignment edge that can align with an opposite second wall of the concrete cast. If the third embodiment reinforcing stake is preferably made from a material that is slightly elastic so that it can have an overall width that is slightly greater than the distance between the opposite walls of the concrete cast.

The third embodiment stake is first inserted between the post and the concrete cast in an angled fashion and then forced between the post and the walls of the concrete cast until all three alignment edges are in contact with opposite walls of the concrete cast. When the upper portion of the reinforcing stake is fastened to the post, the stake provides a structural extension that anchors the post to the concrete cast thereby reinforcing any deteriorated portions of the post. If a second reinforcing stake of the third embodiment is installed on an opposite side of the post, then the post will be returned to a condition that is as strong or even stronger than when it was first installed.

BRIEF DESCRIPTION OF THE DRAWINGS

The invention and its many attendant objects and advantages will become better understood upon reading the following description of the preferred embodiment in conjunction with the following drawings, wherein:

First Embodiment

FIG. 2 is a cross section side view of the first embodiment of the hardware of the present invention using a modified stake driver shown in relation to a post.

FIG. 2A is a cross section side view of an alternate design for the stake driver of the first embodiment of the present invention shown in FIG. 2.

FIG. 3 is a top view of the hardware of the first embodiment of the present invention taken from plane 3—3 of FIG. 2.

Second Embodiment

Figure 7:
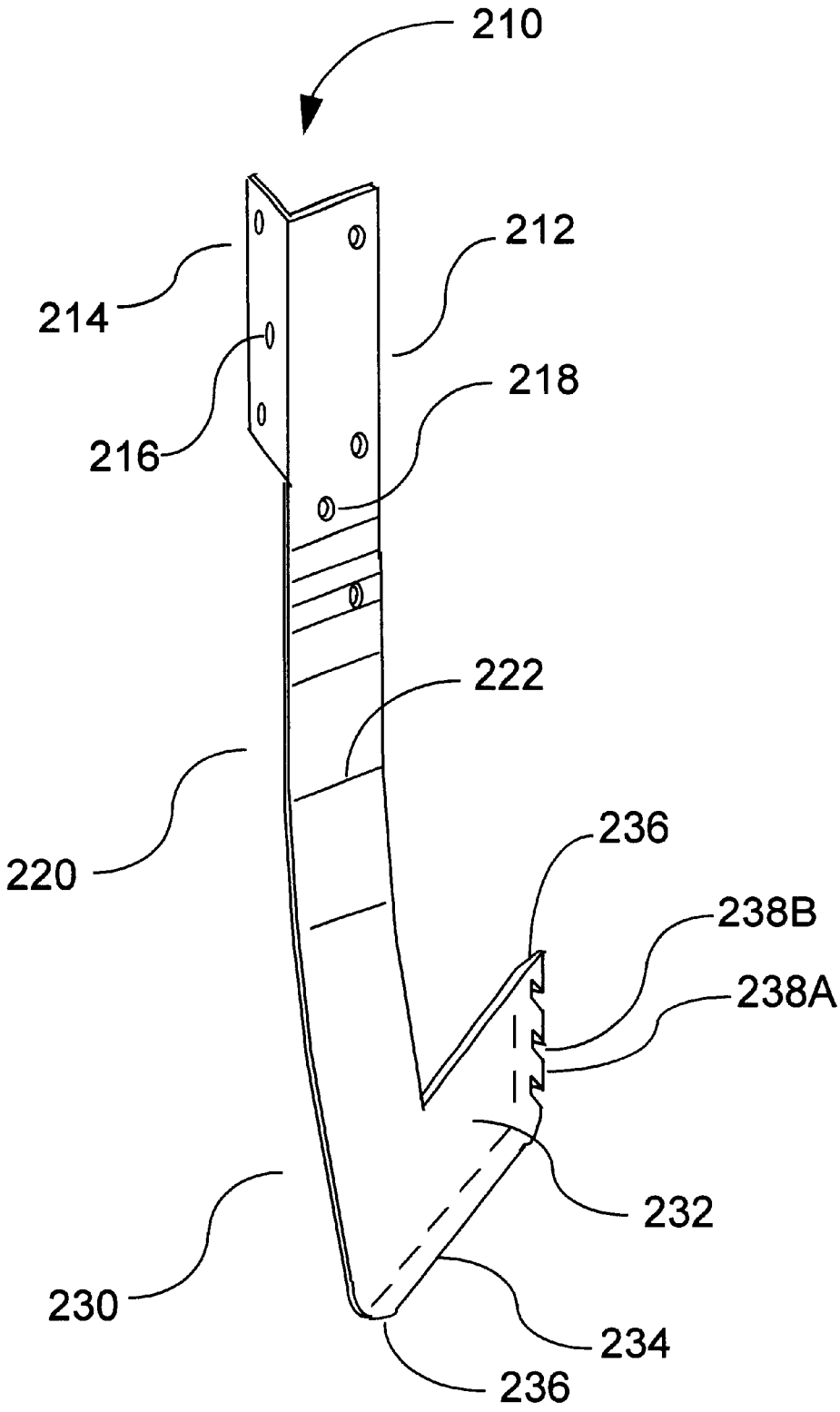

FIG. 7 is a perspective view of the repair stake of the second embodiment of the present invention.

Figure 8:
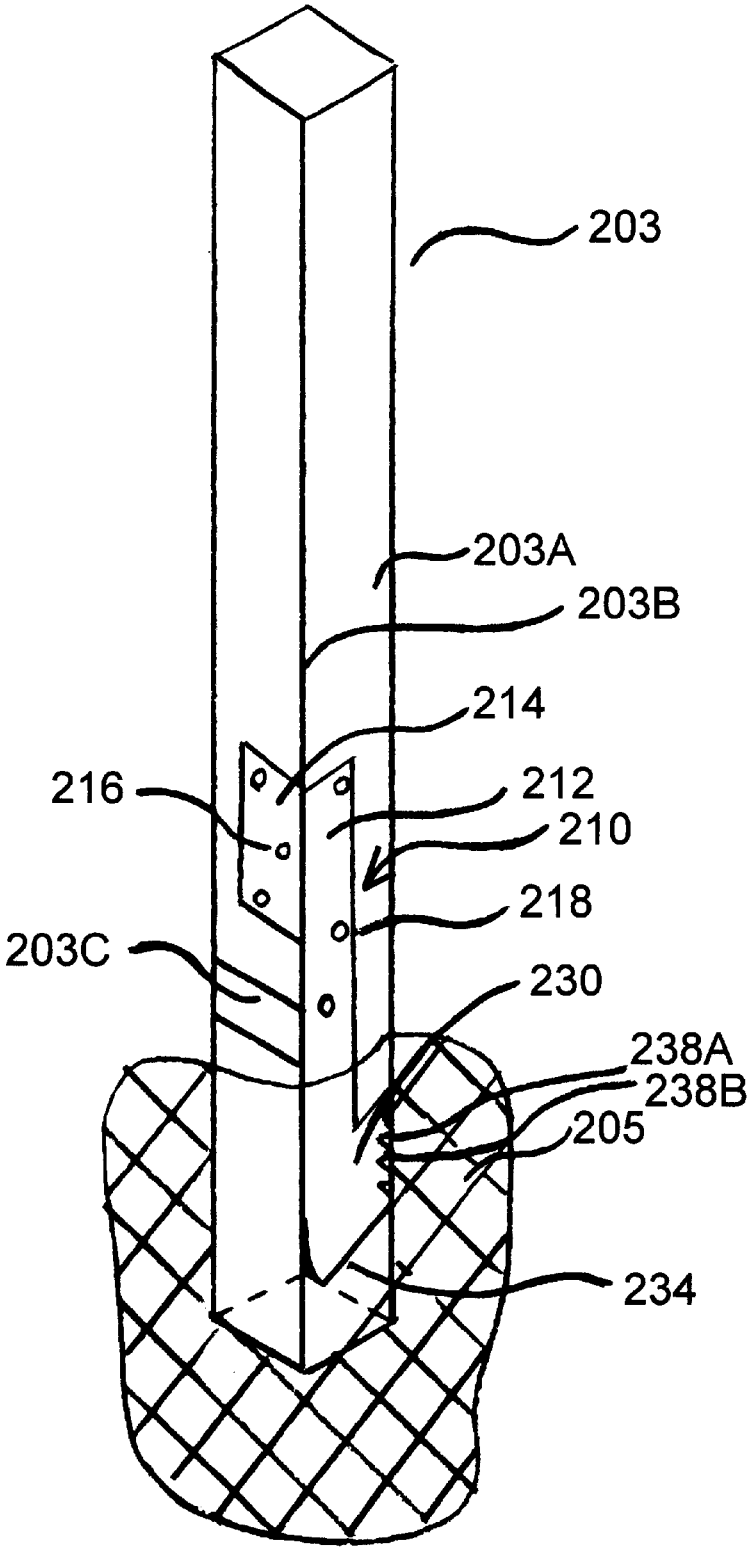

FIG. 8 is a perspective view of the repair stake of the second embodiment of the present invention shown installed in relation to a fence post.

Figure 9:
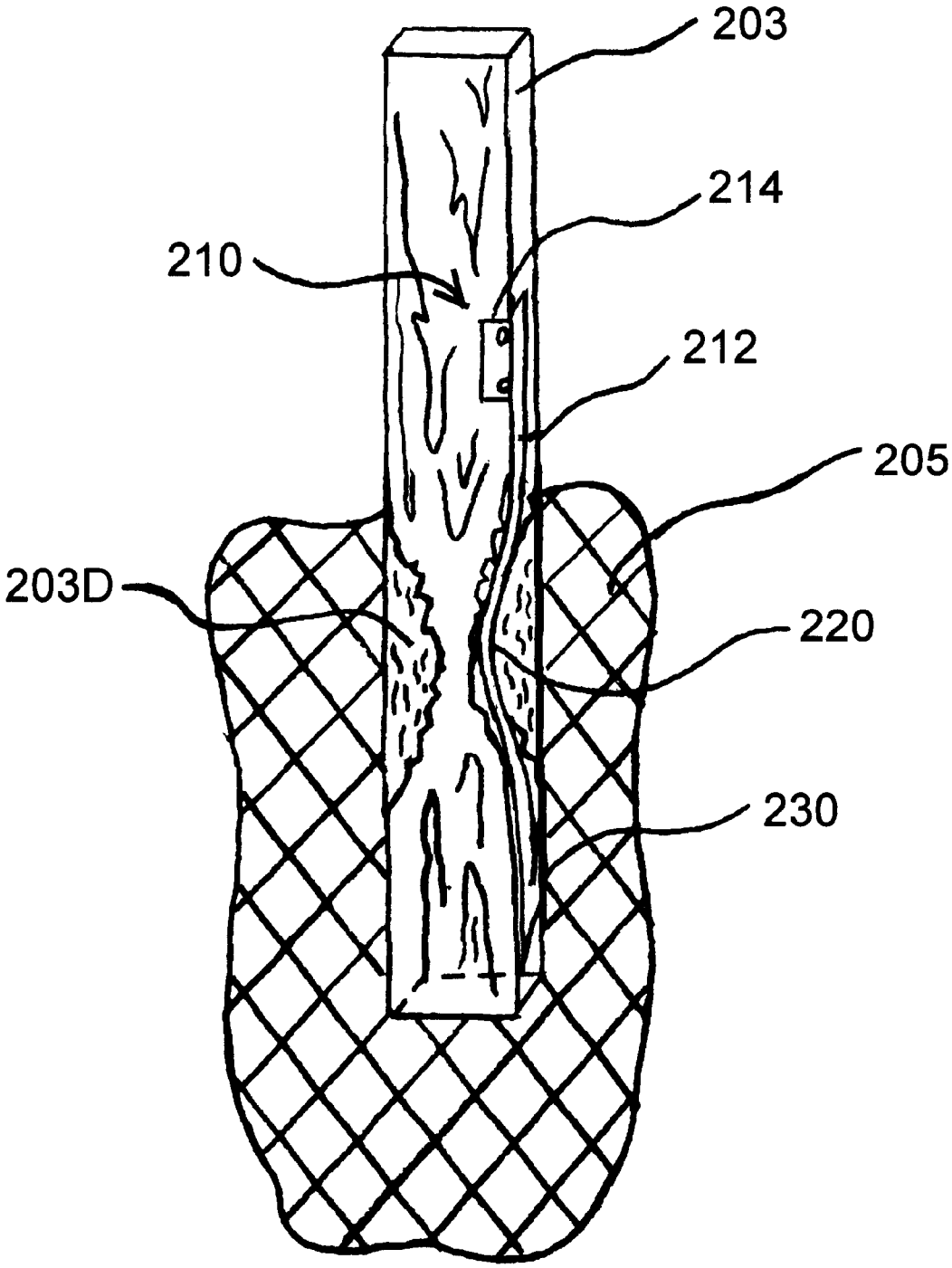

FIG. 9 is a perspective view of the repair stake of the of the second embodiment of the present invention shown installed in relation to a severely damaged fence post.

Third Embodiment

Figure 10:
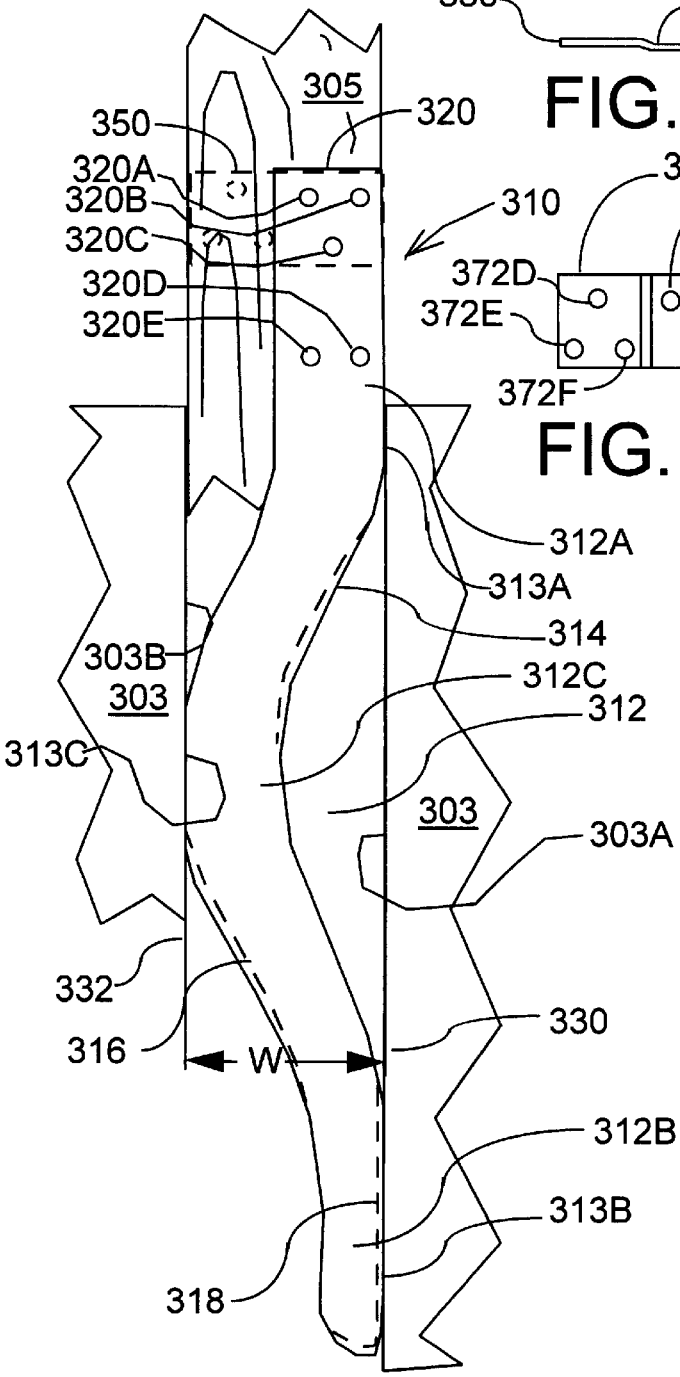

FIG. 10 is cut away side view of a third embodiment of the repair stake of the present invention shown in relation to a fence post.

Figure 11B:
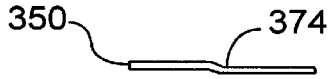
Figure 11A:
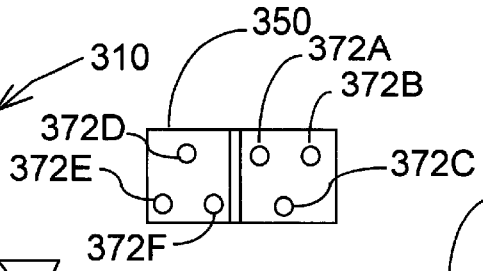

FIG. 11A is a plan view of a reinforcing bracket that is used with the third embodiment of the repair stake of the present invention.

FIG. 11B is a top view of a reinforcing bracket that is used with the third embodiment of the repair stake of the present invention.

Figure 12:
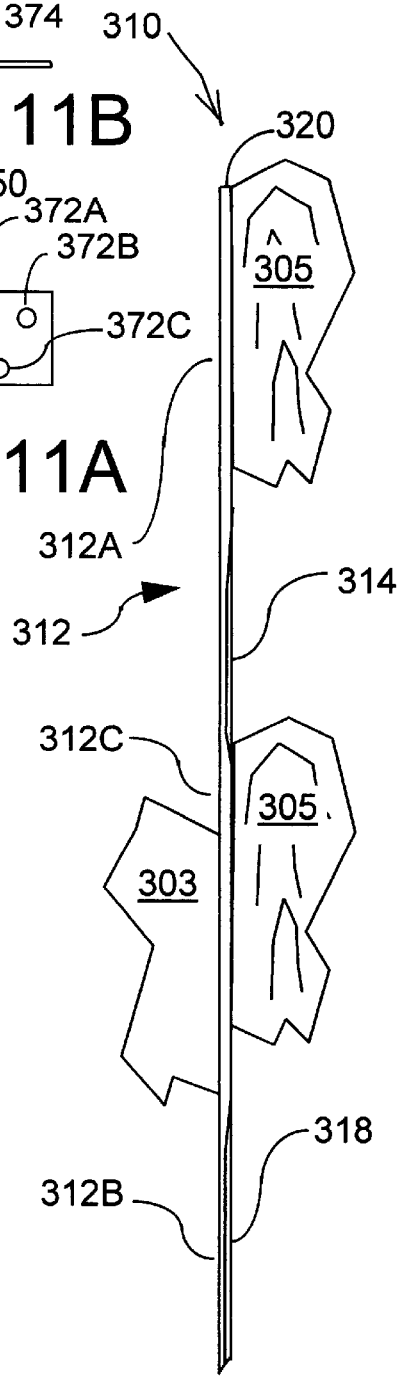

FIG. 12 is a side view of the third embodiment of the repair stake of the present invention shown in FIG. 10.

Figure 13A:
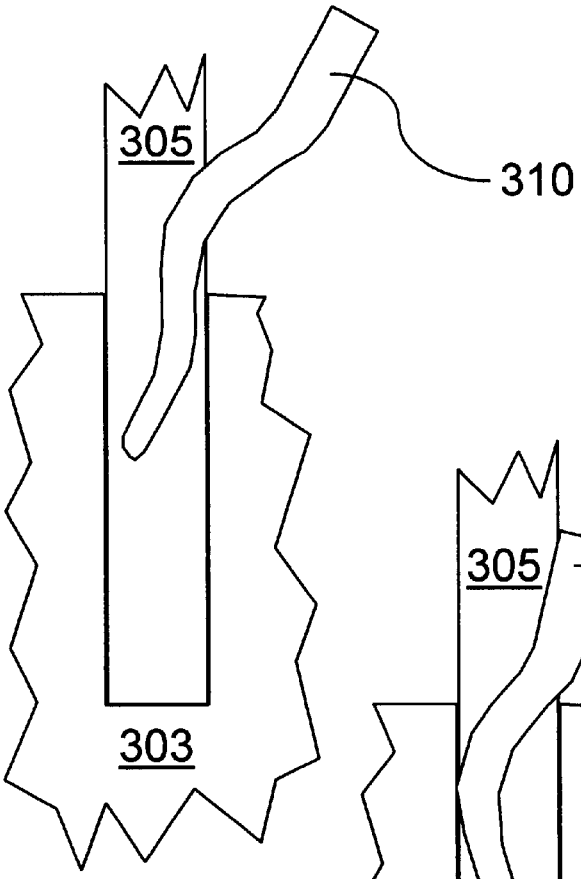

FIG. 13A is a first cut away view of the third embodiment of the repair stake of the present invention being driven between a fence post and a concrete cast.

Figure 13B:
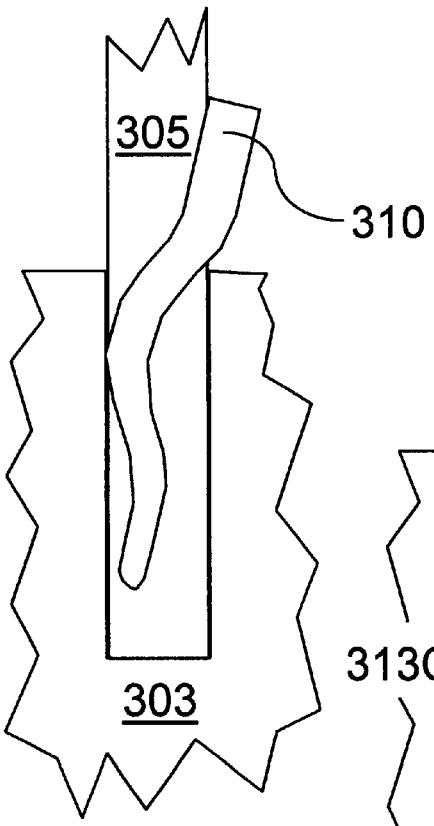

FIG. 13B is a second cut away view of the third embodiment of the repair stake of the present invention being further driven between a fence post and a concrete cast.

Figure 13C:
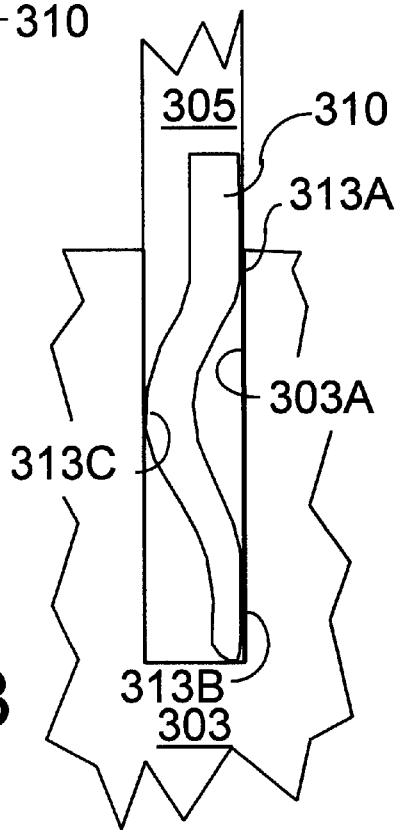

FIG. 13C is a third cut away view of the third embodiment of the repair stake of the present invention that has been completely driven between a fence post and a concrete cast.

DETAILED DESCRIPTION OF THE INVENTION

First Embodiment

Figure 1:
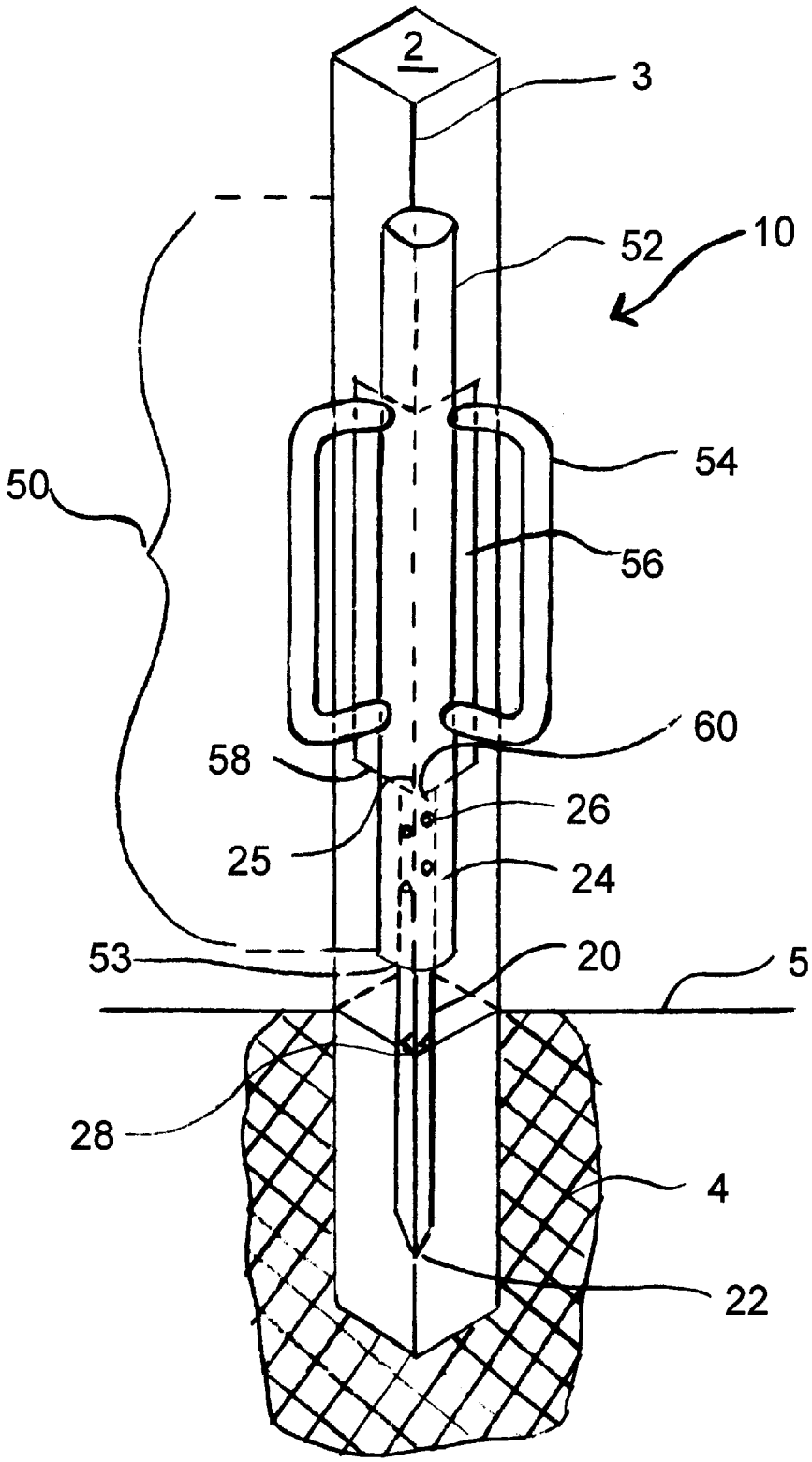
FIG. 1 is a perspective view of the hardware of the first embodiment of the present invention shown in relation to a post.

FIG. 1 shows invention post reinforcing hardware 10 in relation to a post 2. Post 2 is rectangular in cross section and includes a corner 3. Post 2 is imbedded in a concrete cast 4 that extends below the surface of ground 5. Invention hardware 10 includes a stake 20 and a stake driver 50. Stake 20 includes a lower end 22 and an upper portion 24 having a flat upper surface 25. Stake 20 also includes fastener holes 26 and cleats 28. Stake 20 is preferably made from a right angle steel form that can fit against corner 3 of stake 2. Cleats 28 project from the surface of stake 20 and provide a means to gauge when stake 20 has been driven into the ground to a proper depth. Stake driver 50 includes a body 52, handles 54 and flanges 56. Stake driver 50 can be made from a common steel post driver which would include a hollow cylindrical body and a weighted, closed head portion. As can be seen from FIG. 1, flanges 56 can be formed from a right angle steel form that also fits against corner 3 of stake 2. Flanges 56 define at their base a flat hammer surface 58 for striking flat upper surface 25 of stake 20. Body 52 extends below flat hammer surface 58 and has an inside surface 60 that is offset away from post 2 by a distance at least as great as the thickness of stake 20. Inside surface 60 traps stake 20 between post 2 and stake driver 50. Handles 54 extend away from body 52 and are used to slide stake driver 50 up and down corner 3 of post 2.

FIG. 2 and FIG. 3 provide a cut away view and a top view of a second configuration of the first embodiment of the first embodiment of the present invention including a stake 20 and a stake driver 150 shown in relation to a rectangular post 102 having a corner 103. Rectangular post 102 is partially imbedded in ground 105. Stake 20 as is also shown in FIG. 1, has a lower end 22 and an upper surface 25. Stake driver 150 includes a body 152, handles 154, first flanges 156 and second flanges 162. First flanges 156 are fixed to body 156 and have inner surfaces that follow the surfaces of corner 103 of post 102. Shown in cross section at the bottom of one of first flanges 156 is hammer surface 160. Both of first flanges 156 have a hammer surface 160 that define a continuous flat surface for striking down upon upper surface 25 of stake 20. Both second flanges 162 can be seen in the top view of FIG. 3. One of second flanges 162 is shown in cross section in FIG. 2. As can be seen in FIG. 2, second flanges 162 are offset away from post 102 to clear stake 20. If stake driver 150 is held firmly against post 102 while being slid up an down along corner 103 of post 102, second flanges 162 will retain stake 20 against post 102 as stake 20 is driven into ground 105. FIG. 2A presents an alternative configuration where second flanges 162A are curved outwardly and much shorter than second flanges 162 in FIG. 2. Second flanges 162 curve outwardly to catch stake 20 and push it back against post 102 as driver 150 descends down upon stake 20.

Figure 4:
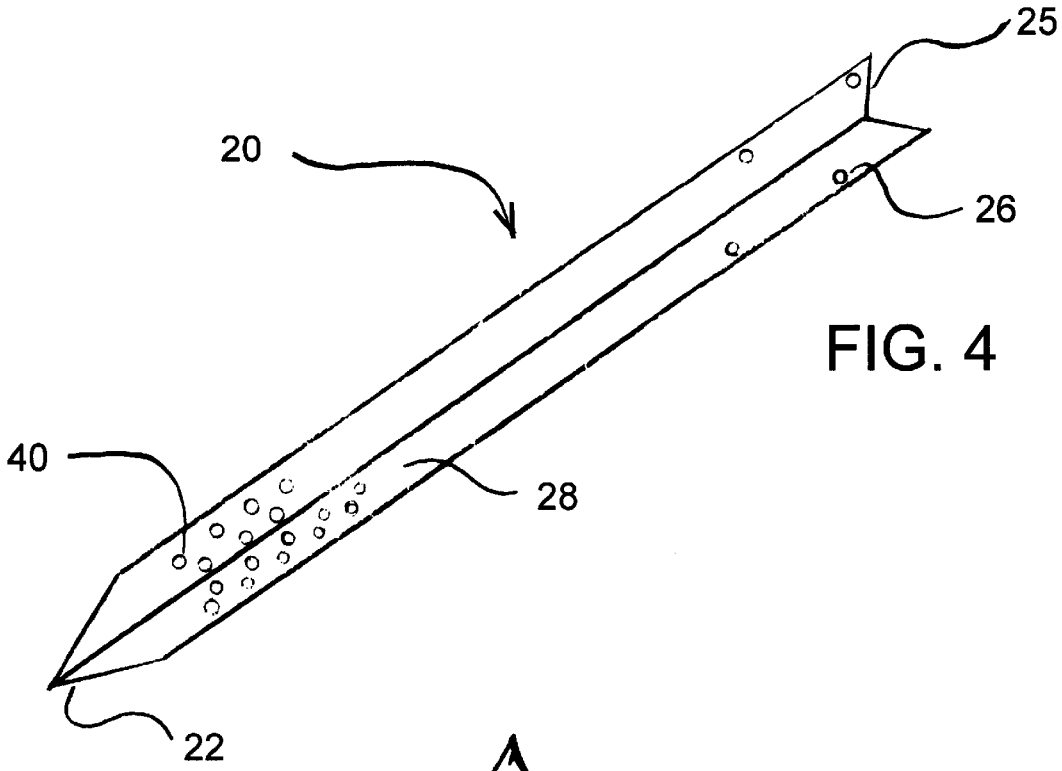
FIG. 4 is a perspective view of a stake of the first embodiment.
Figure 5:
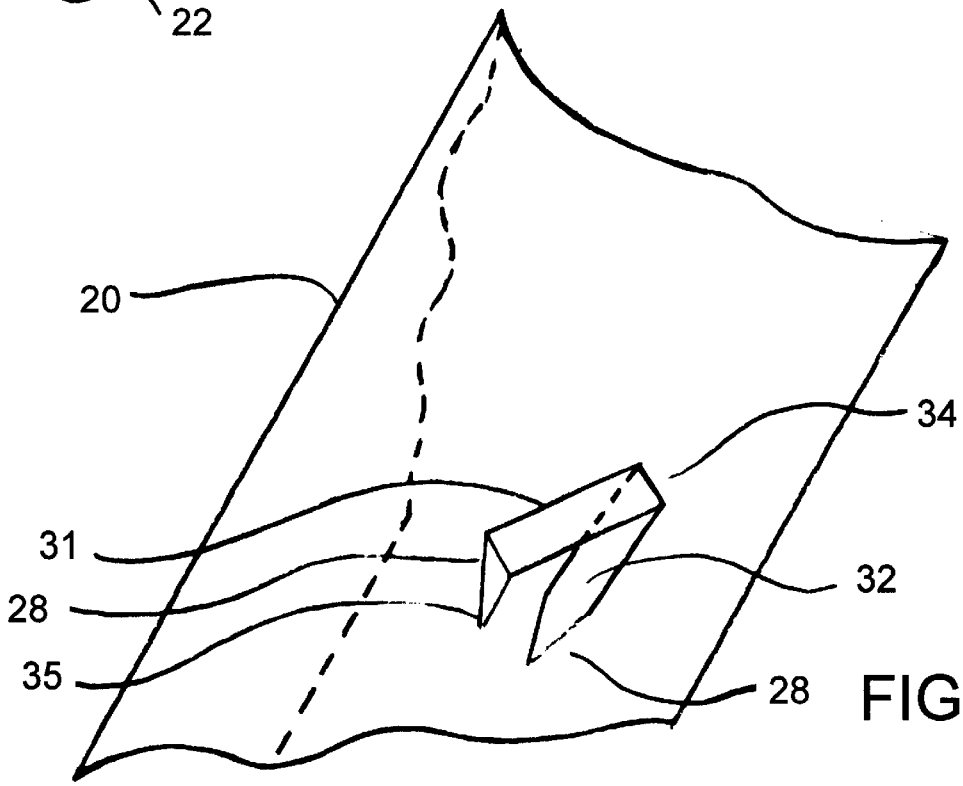
FIG. 5 is a magnified view of a portion of the surface of a stake of the first embodiment.

FIG. 4 and FIG. 5 provide more details of the design of stake 20. As described above, stake 20 includes an upper surface 25, a lower end 22, fastener holes 26 and cleats 28. One of cleats 28 is shown in more detail in the close up view of FIG. 5. Cleat 28 shown in FIG. 5 includes a cleat arm 31, a cleat cut out 32, a first cleat bend 34, a second cleat bend 38 and a cleat spike 35. As can be seen in FIG. 5, cleat 28 can be punched out of the material of stake 20. Cleat 28 provides a feature for preventing stake 20 from penetrating the ground more than a predetermined distance. A nail such as a cut nail or a pin can also be inserted into a hole near the location of cleats 28 to provide a feature to gauge the penetration of stake 20. For stabilizing four inch by four inch post of six to eight feet in height that is imbedded in cement, stake 20 is preferably 36 inches long and cleat 28 is preferably positioned so that stake 20 does not penetrate the ground significantly more than 12 inches. Stake 20 may also be given perforations 40 that will receive the roots of plant growth to further anchor stake 20.

Figure 6:
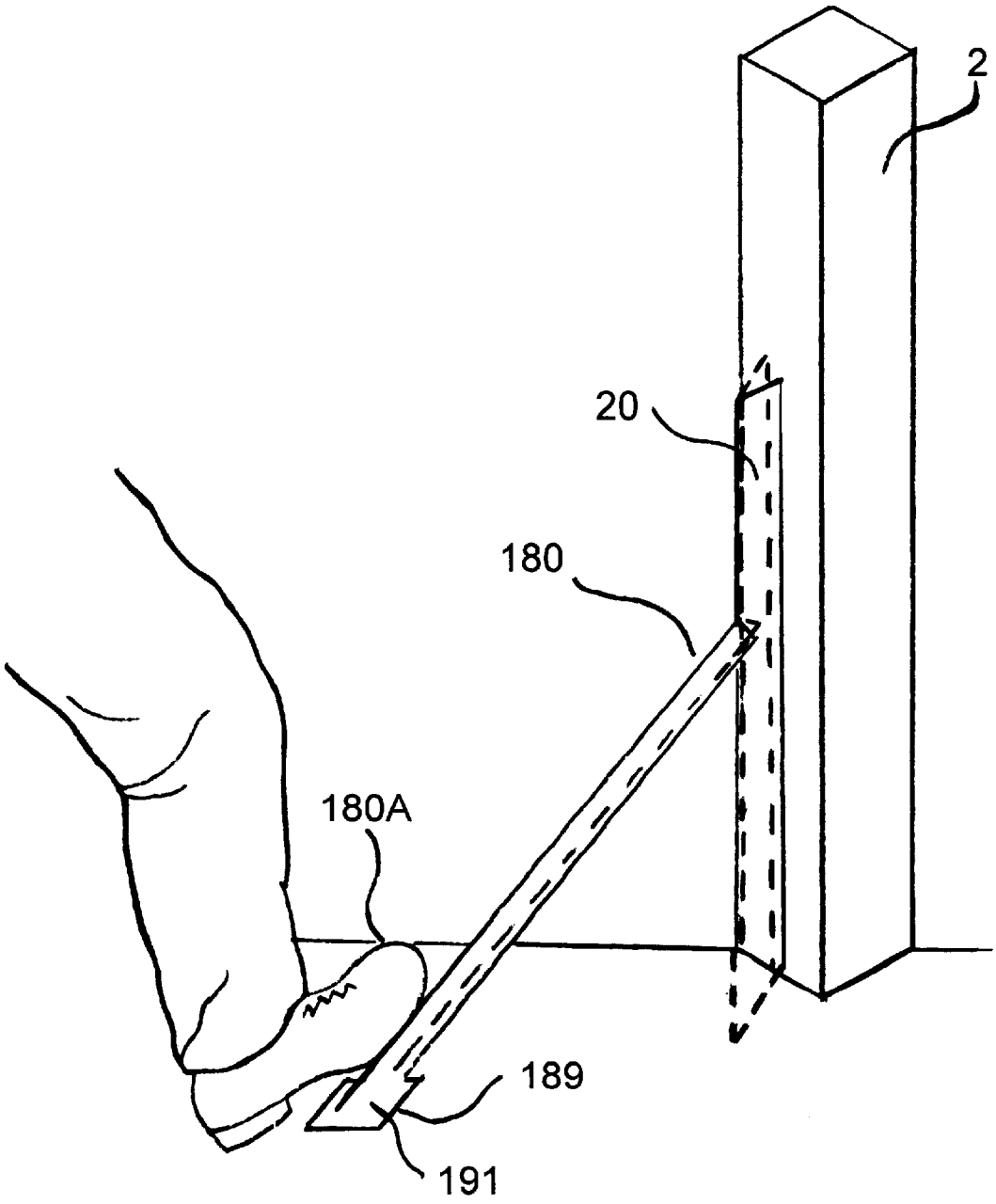
FIG. 6 is a perspective view of a bracing tool used to hold a stake of the first embodiment against a post.

FIG. 6 illustrates a bracing tool 180 that can be used hold stake 20 against post 2. Bracing tool 180 includes a foot 189 that is held in place by a cleat 191. Cleat 191 can also be replaced by a pin or nail driven through a hole in foot 189. Foot 189 is attached to bracing tool 180 by a hinge that allows foot 189 to pivot so that bracing tool 180 can be used at different angles. A worker can apply pressure against stake 20 with his boot 180A.

The method for reinforcing a deteriorated post can be best understood by referring again to FIG. 1 and FIG. 6. To repair a rotten post, a worker would execute the following steps: (1) Place stake 20 on top of old concrete mass 4 and against corner 3 of post 2. (2) Place bracing tool 180 shown in FIG. 6 against angle stake 20 with cleat 191 of foot 189 penetrating ground 5. Bracing tool cleated foot 191 is placed on the ground. Bracing tool 180 holds angle iron stake firmly against corner 3 of post 2. (3) Grasp handles 54 of stake driver 50 and place stake driver 50 on top of stake 20, so that hammer surface 58 rests on upper surface 25 of stake 20. (4) Lift stake driver 50 by an amount so that the lower end 53 of body 52 does not rise above upper surface 25 of stake 20 while holding stake driver 50 against post 2. (5) Slide stake driver 50 down corner 3 of post 2 until hammer surface 58 of stake driver 50 impacts upper surface 25 of stake 20 forcing stake 20 down between post 2 and concrete mass 4. (5) Repeat step 5 until cleat 28 touches concrete mass 4. (6) Install fasteners in fastener holes 26 to secure stake 20 to post 2. The purpose of cleat 28 is to keep stake 20 from settling deeper into the ground over time. Steps 1 through 6 are then repeated on at least one other corner of the post to provide two installed stakes.

Long after post 2 has been reinforced as described above, the remaining portions of the fence structure may deteriorate to the point where the entire fence must be replaced. By this time the post will be totally or substantially consumed below ground. To completely replace the fence structure in the distant future, a worker removes the fasteners from fastener holes 26 and then removes the deteriorated fence structure. The two stakes 20 and concrete mass 4 will remain. At this point, the worker simply places the new post into the existing support structure defined by stakes 20. When the new post is placed in this structure, it can be placed on top of a spacer such as a brick placed on top of concrete mass 4. Fasteners are then installed in holes 26 where fasteners were previously removed. The spacer can be removed and used for the next post installation. At this point, the a post is installed that is not in contact with the ground and that will not deteriorate. At this point, the worker can also install additional stakes to at least one of the two remaining unstaked corners of the post using the tools and method described above. Also at this point, the worker may add concrete to the center of concrete mass 4 to further stabilize the new installation.

As the skilled reader can see from the forgoing description, the hardware and method of the present invention provides an efficient and effective way to reinforce deteriorated fence posts to greatly prolong the life of a fence structure while restoring the structural integrity of a fence structure. The hardware of the present invention is easy to manufacturer and only a low degree of manual skill is needed to practice the method of the present invention. With the hardware and method of the present invention it will now be possible to restore post supported structure at low cost without waste of materials and labor.

Second Embodiment

FIG. 7 provides a perspective view of a second of a repair stake 210 which is a second embodiment of the present invention. Repair stake 210 includes an upper portion 212, a slightly curved central portion 220 and a lower portion 230. As can be seen in FIG. 7, repair stake 210 can be fashioned from a flat sheet of material such as steel. Repair stake 210 is generally flat except for the slightly curved central portion and a fastening flange 214 that projects at a right angle from upper portion 212. A set of fastener holes 216 are drilled into fastening flange 214 and another set of fastening holes 216 are drilled into upper portion 212. A set of forming markings 222 in central portion 220 are a remnant of a forming process where grooves are pounded into the surface of central portion 220 to impart a slight curve. Any one of a number of forming processes can be used to form central portion 220, however, it is important that the resulting formed material have a resilient spring like property.

Lower portion 230 of stake 210 shown in FIG. 7 has several important features. A cutting flange 232 extends away from lower portion 230 in the same plane as lower portion 230. Lower portion 230 includes a cutting edge 234 that begins with blended fillet 236 and extends at substantially a 45° angle in relation to stake 210. Cutting edge 234 includes a beveled surface 236. Along the vertical portion of cutting edge 234 are alternating cutting teeth 238A and flutes 238B.

Although cutting flange 232 and fastening flange 212 have the configurations shown in FIG. 7, those configurations can be altered so that a number of stakes can be cut from a single piece of sheet material with a minimum of scrap. This would be accomplished by changing the shape of fastening flange 212 to complement the shape of cutting flange 232 so that alternating flat patterns for stake 210 can be fit together on a single sheet to minimize scrap. Stake 210 can be fashioned from mild steel or even from a hard plastic material. If stake 210 is fashioned from hard plastic, cutting teeth 238A may grind away during installation.

FIG. 8 illustrates stake 210 installed in relation to a post 203 partially embedded in a concrete cast 205. Post 203 includes a first side 203A and a corner 203B. The width of lower portion 230 of stake 210 is slightly greater (by perhaps six or seven hundredths of an inch) than the width of first side 203A of post 203 and the opening in concrete cast 5. Cutting edge 234 is angled and therefore pushes stake 210 toward center corner 203B of post 203 as stake 210 is driven down between post 203 and concrete cast 205. As stake 210 is driven down between post 203 and concrete cast 205 it interferes slightly with concrete cast 205 because it is very slightly wider than post 203. During this interfering encounter with concrete cast 205, alternating teeth 238A and flutes 238B along the vertical portion of cutting edge 234 grind away concrete cast 205 so that concrete cast 205 does not crack. Because stake 210 is slightly curved when lower portion 230 a placed flat against post 203 just above concrete cast 205, upper portion 212 is spaced away from the side 203A of post 203 so that it can be struck with a hammer. As stake 210 is driven down between post 203 and cast 205, stake 210 straightens against side 203A of post 203 until upper portion 212 of stake 210 is very close to the side of post 203. At this point, fastening flange 214 of upper portion 212 is also in position against an adjacent side of post 203. Fasteners can be installed in fastener holes 216 and fastener holes 218 to secure stake 210 to post 203. Since stake 210 is a flat member, it is possible to cut away a portion 203C of post 203 just above a rotted termite infested portion of post 203. The portions of post 203 to which upper portion 212 of stake 210 is fastened is more solid than the damaged portion embedded in concrete cast 205. Accordingly the overall width of the installation is greater at upper portion 212 of stake 210. Because of this greater above ground width, if post 203 settles further into concrete cast 205, the installation will only become tighter. As can be seen in FIG. 9, because of curved central portion 220, stake 210 will conform to a deteriorated portion 203D of post 203.

The method for installing stake 210 is exceedingly simple and can be understood by referring to FIG. 8. This method includes the following steps: (1) Hold stake 210 against side 203A of the fence post 203 with the lower portion 230 of the stake 210 in contact with the side 203A and upper portion 212 bent away from side 203A of fence post 203. The edges of bottom portion 230 of stake 210 should align with the edges of fence post 203. (2) Strike the top end of the upper portion 212 of stake 210 to drive lower portion 230 of stake 210 between fence post 203 and concrete cast 105 until upper portion 212 of stake 210 is so close to side 203A of fence post 210 that it can no longer be struck with the hammer. (3) Secure upper portion 212 of stake 210 to fence post 203 by inserting fasteners through fastening holes 216 and 218. The resulting installation, if performed again on a second corner of fence post 210 will reinforce that fence post to its original strength.

As the skilled reader can see from the forgoing description, the repair stake and method of the present invention provides an efficient and effective way to reinforce deteriorated fence posts to greatly prolong the life of a fence structure while restoring the structural integrity of a fence structure. The repair stake of the present invention is very easy to manufacturer and only a low degree of manual skill is needed to practice the method of the present invention. With the repair stake and method of the present invention it will now be possible to restore post supported structure at low cost without waste of materials and labor.

Third Embodiment

FIG. 10 shows a repair stake 310 which is a third embodiment of the present invention. Repair stake 310 is shown in relation to a fence post 305 and concrete cast 303 which are cut away in FIG. 10 for clarity. The orientation of the view of FIG. 10 is such that repair stake 310 is between the point of view and fence post 305. Repair stake 310 has a flat blade 312 made from a strong rigid material such as steel or aluminum. Blade 312 is curved in a serpentine shape in a plane. Portions of the edges of blade 312 include beveled edges 314, 316 and 318 that slope away from the surface of fence post 305 so that stake 310 tends to move away from post 305 and lay flat against the inside surface of concrete cast 303 as it is inserted between post 305 and concrete cast 303. Blade 312 of stake 310 includes a generally straight upper portion 312A, a generally straight lower portion 312B and a curved central portion 312C connecting upper portion 312A and lower portion 312B. Upper portion 312A has a first alignment edge 313A that corresponds to a second alignment edge 313B of lower portion 312B. First alignment edge 313A and second alignment edge 313B contact a first wall 303A of concrete cast 303. Central portion 312C has a third alignment edge 313C which contacts an opposite second wall 303B of concrete cast 303. Blade 312 also includes a top surface 320 that is suitable for receiving the striking blows of a hammer. Blade 312 of stake 310 has a pattern of fastener holes 322A, 322B, 322C, 322D and 322E where fasteners may be installed to secure stake 312 to post 305.

A reinforcing plate 350 is shown in FIG. 11A and FIG. 11B. Reinforcing plate 350 can be installed on top of stake 310 by installing fasteners through corresponding fastener holes 372A, 372B and 372C. Other fasteners can then be installed in fastener holes 372D, 372E and 372F to secure reinforcing plate 350 to fence post 305. As can be seen in FIG. 11B, reinforcing plate 350 includes a joggle 374 so that it can lay flat against both stake 310 and post 305.

FIG. 13A, FIG. 13B and FIG. 13C illustrate the method for installing stake 310 to reinforce a post 305. FIG. 13A, FIG. 13B and FIG. 13C are cut away views that are cut along a plane that includes the near side of post 305. In this example, post 305 should be considered to be highly deteriorated below the upper surface of concrete cast 303. Because of the deterioration of post 305 near the upper surface of concrete cast 303, it is relatively easy to insert repair stake 310 between post 305 and concrete cast 303 as shown in FIG. 13A. By striking a hammer upon striking surface 322 it is possible to further insert stake 310 between post 305 and concrete cast 303 as shown in FIG. 13B. By continuing to strike a hammer upon striking surface 320 as flexible stake 310 is temporarily bent away from the surface of post 305 (by the insertion of a tool such as a rod or a screw driver shaft between post 305 and stake 310), it is possible to completely insert stake 310 between post 305 and concrete cast 303. Fasteners are then installed into the fastener holes shown in FIG. 10 to secure stake 310 to post 305. The resulting installation essentially supplements the load carrying capability of the deteriorated lower portion of post 305 so that post 305 is as strong as when it was first installed. If an opposite repair stake like repair stake 310 is installed on the opposite side of post 305, post 305 will be completely returned to its original load carrying capability.

As is shown in FIG. 10, blade 312 of stake 310 decreases in width from its top end to its bottom end. Also, blade 312 curves between a first vertical line 330 that aligns with first alignment edge 313A and second alignment edge 313B and a second vertical line 332 that aligns with third alignment edge 313C. The distance between first vertical line 330 and second vertical line 332 is width W which is the overall width of blade 312. Preferably, blade 312 is fashioned from a slightly elastic material so that width W of blade 312, prior to installation, can be slightly greater than the width of post 305 and the distance between cast walls 303A and 303B shown in FIG. 10. When the width of blade 312, W is slightly greater than the width of the opening of cast 303 into which it is inserted, then blade 312, when properly installed, deflects and pushes against cast wall 303A and cast wall 303B of concrete cast 303 at alignment edges 313A, 313B and 313C shown in FIG. 10. This causes blade 312 to lock in position and, when blade 312 is fastened to post 305, effectively extends post 312 by reinforcing the deteriorated portion of post 312 with a truss like structure that is anchored at alignment edges 313A, 313B and 313C to concrete cast 303. Blade 312 should be fashioned from mild sheet steel having sufficient strength to withstand the impact force of a hammer without buckling. Sheet steel having a thickness of approximately 0.10 inches is preferable.

Obviously, in view of the numerous embodiments described above, numerous modifications and variations of the preferred embodiments disclosed herein are possible and will occur to those skilled in the art in view of this description. For example, many functions and advantages are described for the preferred embodiments, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that these modifications and variations, and the equivalents thereof, are to be considered within the spirit and scope of the invention as defined by the following claims, wherein,

I claim:

1. A stake for reinforcing a deteriorated rectangular post that is set within a rectangular opening formed in a concrete footing, comprising:

(a) a generally flat blade having a width that is substantially less than the width of a first side of the rectangular post, the flat blade including;

(1) an upper portion having a alignment edge that can align with a first edge of the first side of the post and a first inside wall of the rectangular opening in which the post is set and fastening holes for receiving fasteners for fastening to the rectangular post, (2) a lower portion also having an alignment edge that substantially aligns with the alignment edge of the upper portion, the alignment edge of the lower portion also for alignment with the first edge of the first side of the post and the first inside wall of the rectangular opening that also aligns with the edge of the upper portion, (3) a curved central portion connecting the upper portion and the lower portion, the curved central portion including an alignment edge for aligning with a second edge of the first side of the post which is opposite the first edge of the first side of the post, the alignment edge of the central curved portion also for aligning with a second inside wall of the rectangular opening which is opposite the first inside wall of the rectangular opening.

2. The fence post reinforcing stake of claim 1 wherein, the alignment edge of the upper portion, the alignment edge of the lower portion and the alignment edge of the central portion define an overall width that is slightly larger than the width of the post and the rectangular opening in which the post is set so that when the stake is completely inserted into the rectangular opening it must deflect within the rectangular opening thereby locking itself within the rectangular opening.

3. The fence post reinforcing stake of claim 1 wherein, at least one edge of the blade is beveled away from the post so that the blade tends to push away from the post and towards the wall of the opening as the blade is inserted between the post and the wall of the opening.

4. The fence post reinforcing stake of claim 1 wherein, at least one edge of the blade is beveled away from the post so that the blade tends to push away from the post and towards the wall of the opening as the blade is inserted between the post and the wall of the opening, and the alignment edge of the upper portion, the alignment edge of the lower portion and the alignment edge of the central portion define an overall width that is slightly larger than the width of the post and the rectangular opening in which the post is set so that when the reinforcing stake is completely inserted into the rectangular opening it must deflect within the rectangular opening thereby locking itself within the rectangular opening.

5. The fence post reinforcing stake of claim 1, further comprising, a flange extending from the top of the upper portion of the blade of the stake that can also be secured to the post.

6. A stake for reinforcing a rectangular post comprising:

(a) a straight, generally flat upper portion having fastening holes for receiving fasteners for fastening to a first surface of the rectangular post, (b) a straight, generally flat lower portion having an angled cutting edge extending in the same plane and at an acute angle in relation to the lower portion, and (c) a slightly curved central portion connecting the upper portion and the lower portion that gives the stake a bowed, three dimensionally curved shape.

7. The fence post reinforcing stake of claim 5 further comprising, a flange fixed to the upper portion extending at substantially a right angle to the upper portion having fastening holes for receiving fasteners for fastening to a second surface of the post.

* * * * *